US011139617B2

(12) United States Patent
Zhang

(10) Patent No.: US 11,139,617 B2
(45) Date of Patent: Oct. 5, 2021

(54) ELECTRICAL CONNECTOR

(71) Applicant: LOTES CO., LTD, Keelung (TW)

(72) Inventor: Jun Zhang, Keelung (TW)

(73) Assignee: LOTES CO., LTD, Keelung (TW)

( * ) Notice: Subject to any disclaimer, the term of this patent is extended or adjusted under 35 U.S.C. 154(b) by 86 days.

(21) Appl. No.: 16/776,864

(22) Filed: Jan. 30, 2020

(65) Prior Publication Data

US 2020/0295512 A1 Sep. 17, 2020

(30) Foreign Application Priority Data

Mar. 11, 2019 (CN) ..... 201920308803.1

(51) Int. Cl.

| | |
|---|---|
| ***H01R 13/6461*** | (2011.01) |
| ***H01R 4/48*** | (2006.01) |
| ***H01R 13/24*** | (2006.01) |
| ***H01R 13/428*** | (2006.01) |

(52) U.S. Cl.

CPC ..... *H01R 13/6461* (2013.01); *H01R 4/48* (2013.01); *H01R 13/2442* (2013.01); *H01R 13/428* (2013.01)

(58) Field of Classification Search

CPC ..... H01R 12/707; H01R 13/6476; H01R 12/7076

See application file for complete search history.

(56) References Cited

U.S. PATENT DOCUMENTS

| | | | | |
|---|---|---|---|---|
| 10,381,756 | B2 * | 8/2019 | Ju | H01R 12/57 |
| 2014/0080327 | A1 * | 3/2014 | Hwang | H01R 13/648 439/65 |
| 2014/0335731 | A1 * | 11/2014 | Chang | H01R 13/6466 439/620.13 |
| 2018/0366881 | A1 * | 12/2018 | Chang | H01R 13/41 |

FOREIGN PATENT DOCUMENTS

| | | | |
|---|---|---|---|
| CN | 1095230 | C | 11/2002 |
| CN | 2735594 | Y | 10/2005 |
| CN | 102195173 | B | 6/2015 |
| CN | 103503248 | B | 8/2018 |

* cited by examiner

*Primary Examiner* — Jean F Duverne

(74) *Attorney, Agent, or Firm* — Locke Lord LLP; Tim Tingkang Xia, Esq.

(57) ABSTRACT

An electrical connector includes an insulating body and multiple differential signal terminal pairs, each having two differential signal terminals. Each differential signal terminal has a main body portion, a strip connecting portion extending upward from an outer side of the main body portion, an elastic arm extending upward from the main body portion, and a contact portion extending upward from the elastic arm. A through slot runs through the elastic arm, forming an inner elastic arm and an outer elastic arm at two opposite sides of the through slot. The outer elastic arm is adjacent to the strip connecting portion. A consistent pitch is formed between the contact portions of the differential signal terminals. A first distance between two adjacent inner elastic arms in each differential signal terminal pair is less than a second distance between two adjacent outer elastic arms in two adjacent differential signal terminal pairs.

10 Claims, 6 Drawing Sheets

A-A

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201920308803.1 filed in China on Mar. 11, 2019. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector with conductive terminals capable of improving high frequency performance thereof.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An electrical connector is used to electrically connect a chip module to a circuit board, and includes an insulating body and multiple differential signal terminal pairs fixed in the insulating body. Each differential signal terminal pair is formed by two differential signal terminals of the same structure. Each differential signal terminal is provided with a main body portion fixed with the insulating body, two strip connecting portions formed by extending upward from the main body portion to be connected to a strip, an elastic arm formed by bending and extending upward from the main body portion and located between the two strip connecting portions, and a contact portion formed by extending upward from a middle position of the elastic arm to upward abut the chip module.

However, the strip connecting portions separating the two elastic arms of the two differential signal terminals in each differential signal terminal pair are arranged therebetween respectively. Thus, a distance between the two elastic arms is relatively long, which is unfavorable for coupling of the differential signal terminal pair, and may lead to crosstalk and result in difficulties to meet a requirement on high frequency signal transmission performance.

Therefore, a heretofore unaddressed need to design a new electrical connector exists in the art to address the aforementioned deficiencies and inadequacies.

SUMMARY

The present invention is directed to an electrical connector having lower crosstalk between differential signal terminal pairs to improve the high frequency performance thereof.

To achieve the foregoing objective, the present invention adopts the following technical solutions.

An electrical connector includes: an insulating body; and a plurality of differential signal terminal pairs accommodated in the insulating body, wherein each of the differential signal terminal pairs is formed by two differential signal terminals, and each of the differential signal terminals has: a main body portion; a strip connecting portion extending upward from an outer side of the main body portion; an elastic arm extending upward from the main body portion; and a contact portion formed by extending upward from the elastic arm, wherein a through slot runs through the elastic arm, such that the elastic arm forms an inner elastic arm and an outer elastic arm at two opposite sides of the through slot, the outer elastic arm is adjacent to the strip connecting portion, the through slot does not extend to the contact portion, the contact portion is located at an outer side of a virtual center line of the through slot, and a consistent pitch is formed between the contact portions of the differential signal terminals.

In certain embodiments, in each of the differential signal terminal pairs, the two adjacent inner elastic arms of the two differential signal terminals are parallel, and a pitch between the two through slots of the two differential signal terminals is shorter than the pitch between the two contact portions of the two differential signal terminals.

In certain embodiments, an inner clamping portion and an outer clamping portion extend from the main body portion, the inner clamping portion and the outer clamping portion clamp a solder ball, and along a downward-from-top direction, the inner clamping portion is covered by the inner elastic arm, and the outer clamping portion is exposed at an outer side of the outer elastic arm.

In certain embodiments, a strip is provided with a row of connecting portions at intervals, each of the connecting portions connects the strip connecting portions of two of the differential signal terminals, and the two differential signal terminals between two adjacent ones of the connecting portions form one of the differential signal terminal pairs.

Compared with the related art, the electrical connector according to certain embodiments of the present invention has the following beneficial effects.

The strip connecting portions of the two differential signal terminals are located at the outer sides of the corresponding differential signal terminal pair, and the contact portions are located at the outer side of the virtual center line of the through slot, such that on the premise of ensuring that the pitch between the contact portions of the differential signal terminals, a distance between the two adjacent inner elastic arms of the differential signal terminal pair is reduced, thereby enhancing the coupling of the two differential signal terminals in each of the differential signal terminal pairs, reducing crosstalk, and improving the high frequency performance of the electrical connector.

To achieve the foregoing objective, the present invention further adopts the following technical solutions.

An electrical connector includes: an insulating body; and a plurality of differential signal terminal pairs accommodated in the insulating body, wherein each of the differential signal terminal pairs is formed by two differential signal terminals, and each of the differential signal terminals has: a main body portion; a strip connecting portion extending upward from an outer side of the main body portion; an elastic arm extending upward from the main body portion; and a contact portion formed by extending upward from the elastic arm, wherein a through slot runs through the elastic arm, such that the elastic arm forms an inner elastic arm and an outer elastic arm at two opposite sides of the through slot, the outer elastic arm is adjacent to the strip connecting portion, the through slot does not extend to the contact portion, a consistent pitch is formed between the contact portions of the differential signal terminals, a first distance is formed between the two adjacent inner elastic arms of the two differential signal terminals in each of the differential signal terminal pairs, a second distance is formed between two adjacent outer elastic arms of two adjacent differential signal terminals in two adjacent ones of the differential signal terminal pairs, and the first distance is less than the second distance.

In certain embodiments, in each of the differential signal terminal pairs, the two adjacent inner elastic arms of the two differential signal terminals are parallel, and a pitch between the two through slots of the two differential signal terminals is shorter than the pitch between the two contact portions of the two differential signal terminals.

In certain embodiments, the main body portion is flat plate shaped, the inner elastic arm and the outer elastic arm are located at one side of the main body portion, and a top surface of the contact portion upward abuts a chip module.

In certain embodiments, the contact portion is located at an outer side of a virtual center line of the through slot, and the two strip connecting portions of the two differential signal terminals in each respective differential signal terminal pair of the differential signal terminal pairs are respectively located at outer sides of the respective differential signal terminal pair.

In certain embodiments, a strip is provided with a row of connecting portions at intervals, each of the connecting portions connects the strip connecting portions of two of the differential signal terminals, and the two differential signal terminals between two adjacent ones of the connecting portions form one of the differential signal terminal pairs.

In certain embodiments, an inner clamping portion and an outer clamping portion extend from the main body portion, the inner clamping portion and the outer clamping portion clamp a solder ball, and along a downward-from-top direction, the inner clamping portion is covered by the inner elastic arm, and the outer clamping portion is exposed at an outer side of the outer elastic arm.

Compared with the related art, the electrical connector according to certain embodiments of the present invention has the following beneficial effects.

The first distance is formed between the two adjacent inner elastic arms of the two differential signal terminals in each of the differential signal terminal pairs, the second distance is formed between two adjacent outer elastic arms of two adjacent differential signal terminals in two adjacent ones of the differential signal terminal pairs, and the first distance is less than the second distance. Moreover, the strip connecting portions of the two differential signal terminals are only provided at the outer sides of the corresponding differential signal terminal pair, thereby reducing a distance between the two adjacent inner elastic arms of the differential signal terminal pair, reducing crosstalk, and improving the high frequency performance of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
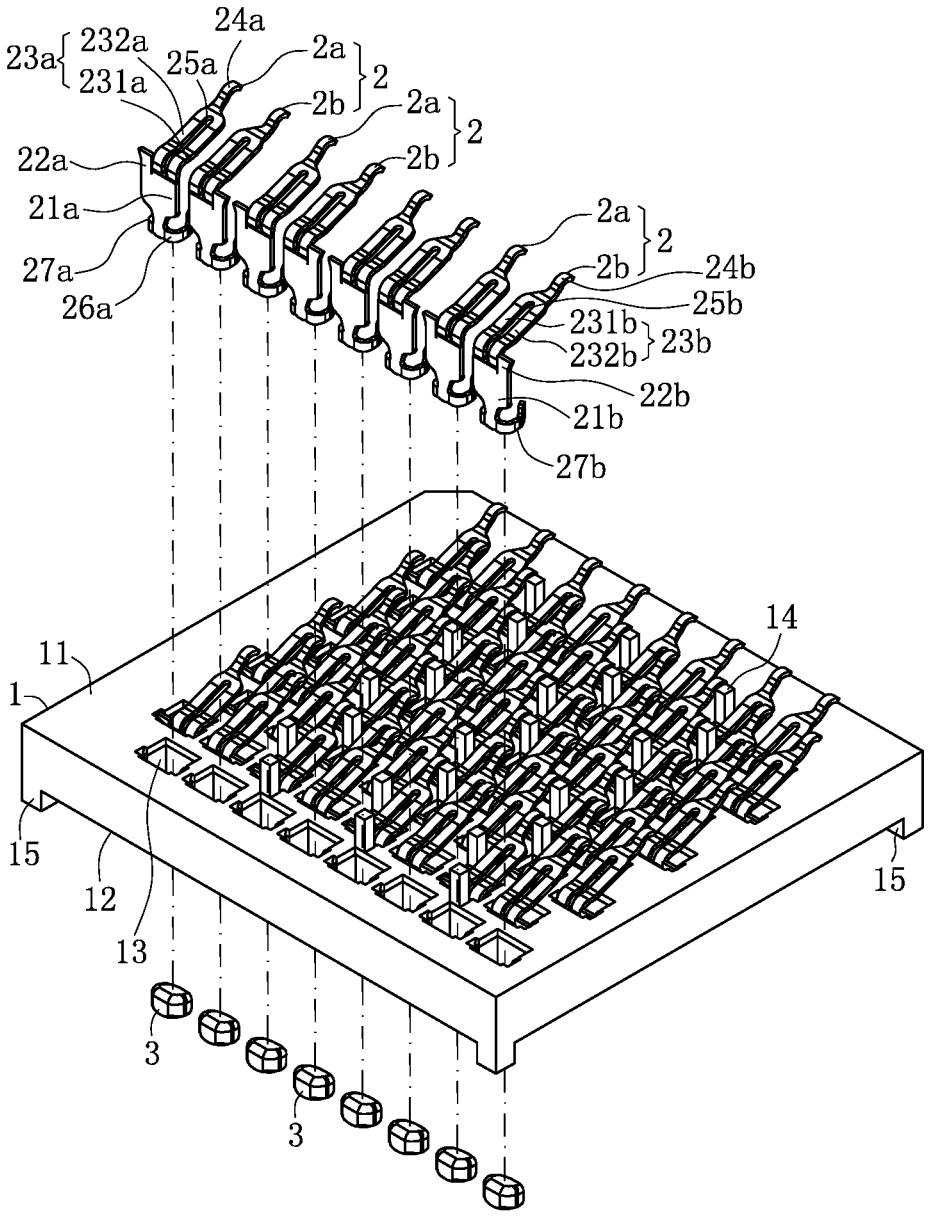
FIG. 1 is a perspective exploded view of an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 2:
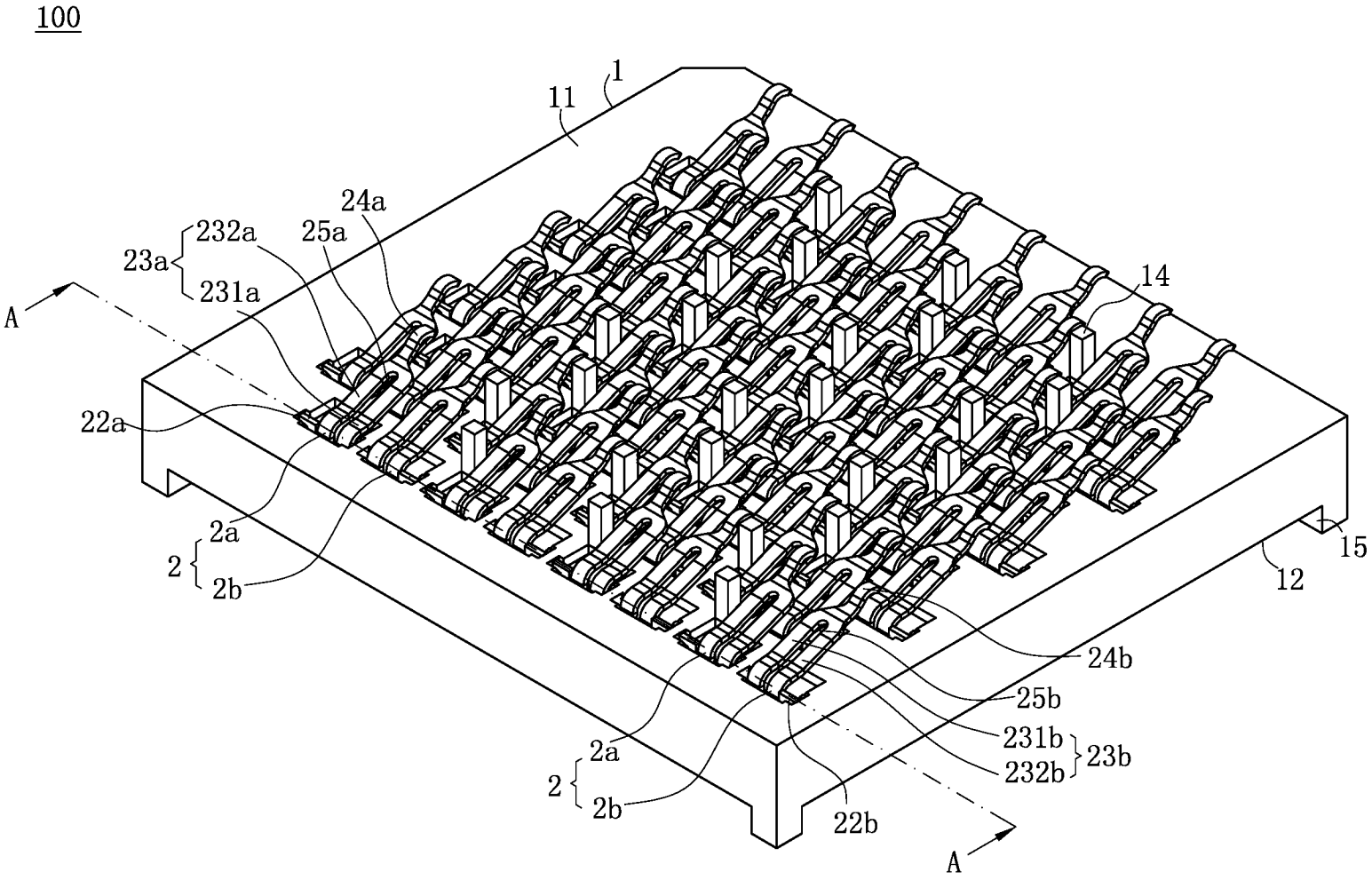
FIG. 2 is a perspective assembly schematic view of the electrical connector according to certain embodiments of the present invention.
Figure 3:
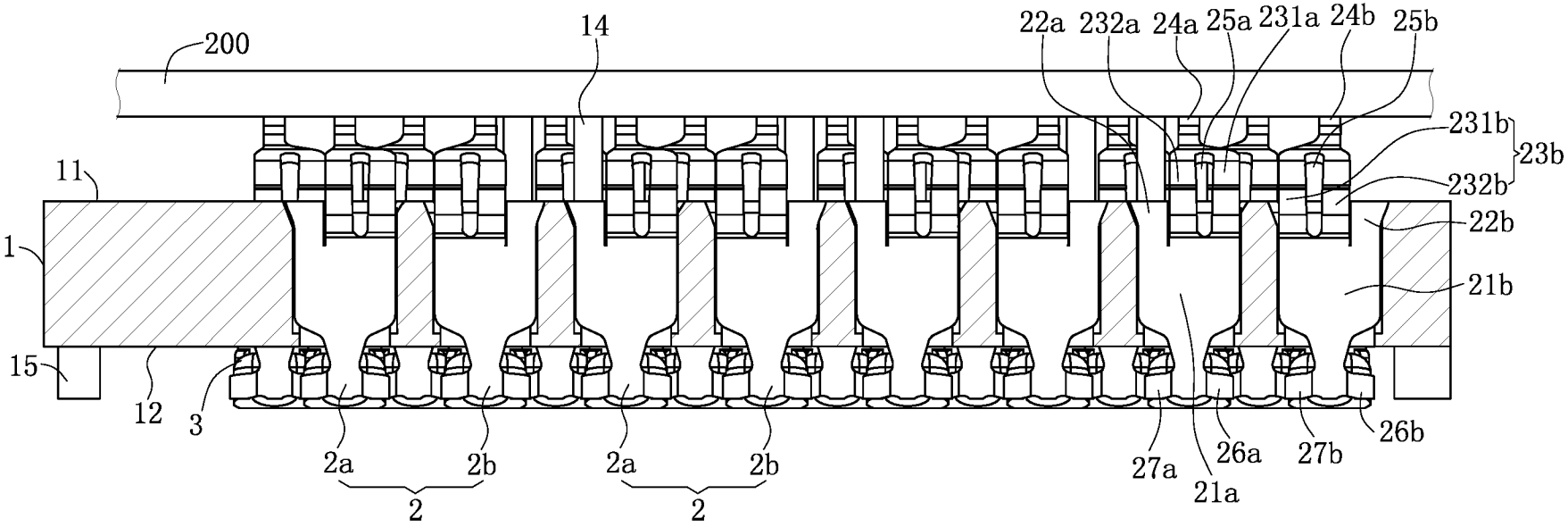
FIG. 3 is a sectional view of FIG. 2 along line A-A.

As shown in FIG. 1 to FIG. 3, an electrical connector 100 according to certain embodiments of the present invention is used to electrically connect a chip module 200 to a circuit board (not shown). The electrical connector 100 includes an insulating body 1, and multiple differential signal terminal pairs 2 correspondingly accommodated in the insulating body 1.

As shown in FIG. 1 to FIG. 3, the insulating body 1 has an upper surface 11 and a lower surface 12. Multiple terminal holes 13 run through the upper surface 11 and the lower surface 12 vertically. Multiple protruding posts 14 protrude upward from the upper surface 11 to support the chip module 200. Multiple supporting posts 15 are provided to protrude downward from the lower surface 12 to support the electrical connector 100 on the circuit board.

As shown in FIG. 1 to FIG. 3, each differential signal terminal pair 2 is formed by a first differential signal terminal 2*a* and a second differential signal terminal 2*b*. The first differential signal terminals 2*a* and the second differential signal terminals 2*b* are correspondingly accommodated in the terminal holes 13 respectively.

Figure 4:
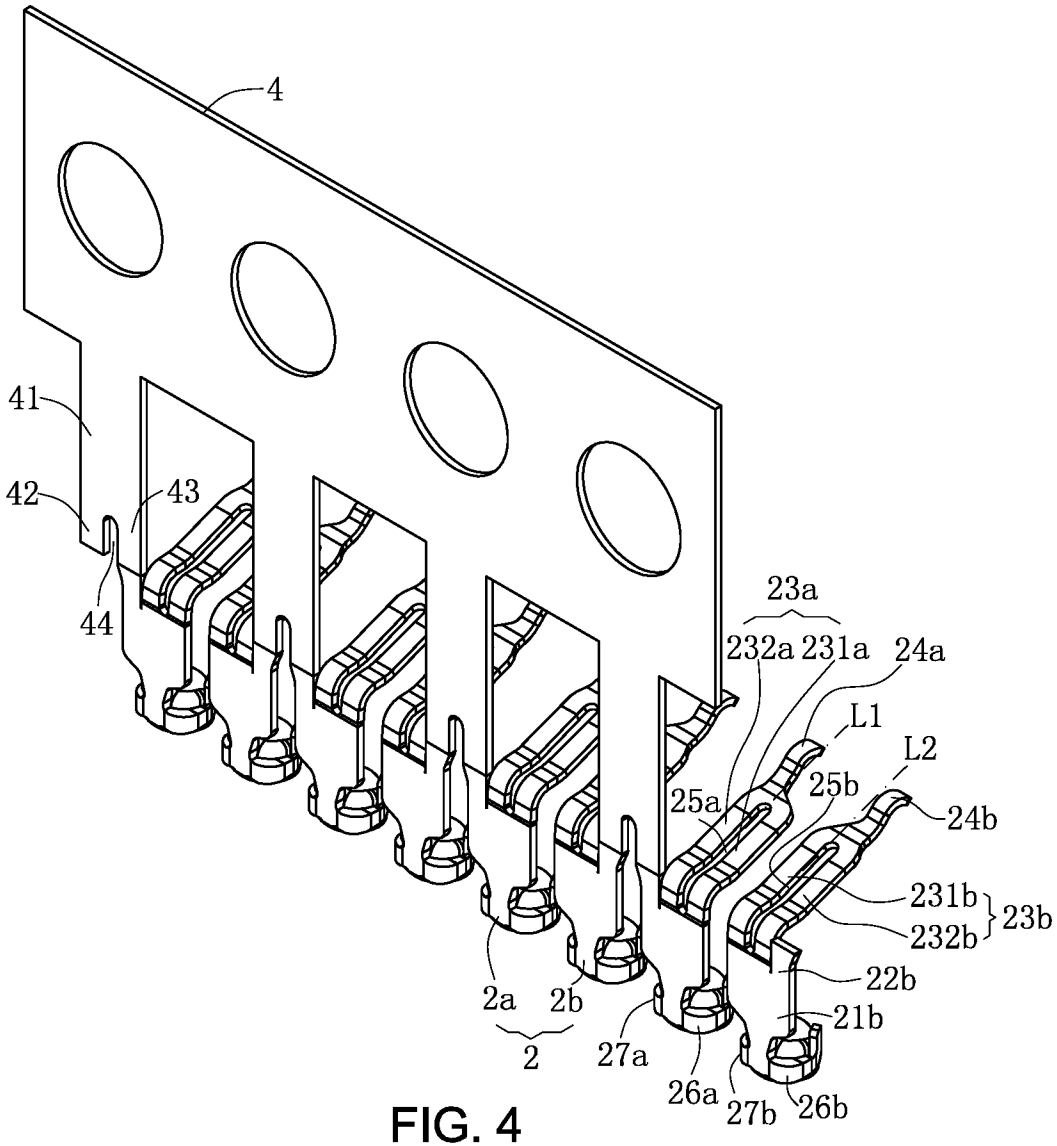
FIG. 4 is a perspective schematic view of a row of differential signal terminal pairs being connected to a strip according to certain embodiments of the present invention.
Figure 5:
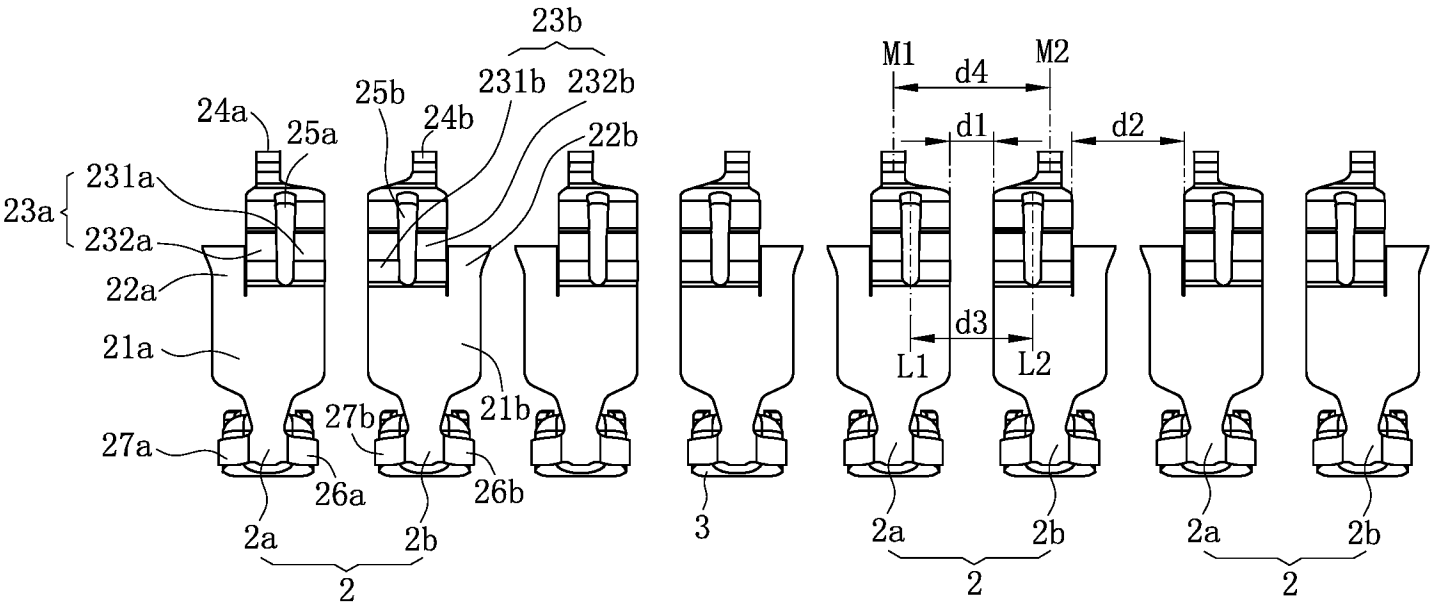
FIG. 5 is a front view of a row of differential signal terminal pairs according to certain embodiments of the present invention.
Figure 6:
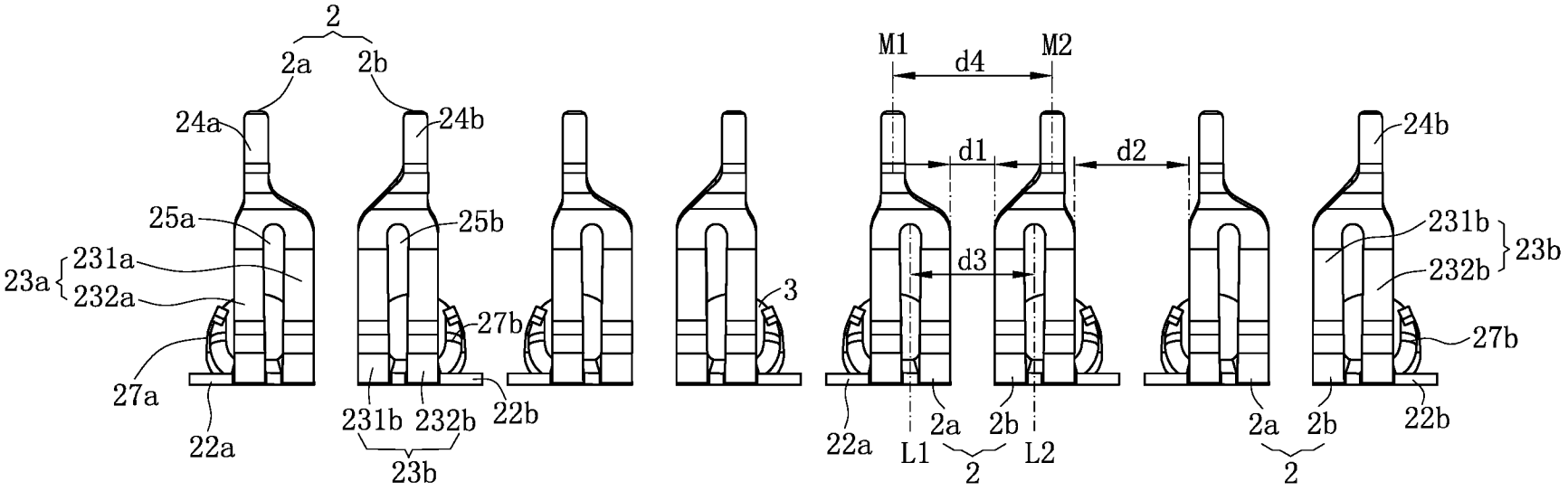
FIG. 6 is a top view of a row of differential signal terminal pairs according to certain embodiments of the present invention.

As shown in FIG. 4 to FIG. 6, each first differential signal terminal 2*a* has a first main body portion 21*a*, which is flat plate shaped. A first strip connecting portion 22*a* extends upward from one side of the first main body portion 21*a*. A first elastic arm 23*a* extends upward from the first main body portion 21*a*. A first contact portion 24*a* is formed by extending upward from the first elastic arm 23*a*, and a top surface of the first contact portion 24*a* upward abuts the chip module 200 (as shown in FIG. 3). A first through slot 25*a* runs through the first elastic arm 23*a* vertically, such that the first elastic arm 23*a* forms a first inner elastic arm 231*a* and a first outer elastic arm 232*a* at two opposite sides of the first through slot 25*a*. The first inner elastic arm 231*a* and the first outer elastic arm 232*a* have identical widths and are parallel to each other. The first outer elastic arm 232*a* is adjacent to the first strip connecting portion 22*a*. The first through slot 25*a* does not extend to the first contact portion 24*a*. The first contact portion 24*a* is located at an outer side of a virtual center line L1 of the first through slot 25*a*. A first inner clamping portion 26*a* and a first outer clamping portion 27*a* extend downward from the first main body portion 21*a*. The first inner clamping portion 26*a* and the first outer clamping portion 27*a* clamp a solder ball 3 to solder the electrical connector 100 on the circuit board. Viewing along a downward-from-top direction, the first inner clamping portion 26*a* is covered by the first inner elastic arm 231*a*, and the first outer clamping portion 27*a* is exposed to an outer side of the first outer elastic arm 232*a*. Each second differential signal terminal 2*b* is provided with a second main body portion 21*b*, which is flat plate shaped. A second strip connecting portion 22*b* extends upward from one side of the second main body portion 21*b*. A second elastic arm 23*b* extends upward from the second main body portion 21*b*. A second contact portion 24*b* is formed by extending upward from the second elastic arm 23*b*, and a top surface of the second contact portion 24*b* upward abuts the chip module 200 (as shown in FIG. 3). A second through slot 25*b* runs through the second elastic arm 23*b* vertically, such that the second elastic arm 23*b* forms a second inner elastic arm 231*b* and a second outer elastic arm 232*b* at two opposite sides of the second through slot 25*b*. The second inner elastic arm 231*b* and the second outer elastic arm 232*b* have identical widths and are parallel to each other. The second outer elastic arm 232*b* is adjacent to the second strip connecting portion 22*b*. The second through slot 25*b* does not extend to the second contact portion 24*b*. The second contact portion 24*b* is located at an outer side of a virtual center line L2 of the second through slot 25*b*. A second inner clamping portion 26*b* and a second outer clamping portion 27*b* extend downward from the second main body portion 21*b*. The second inner clamping portion 26*b* and the second outer clamping portion 27*b* clamp a solder ball 3 to solder the electrical connector 100 on the circuit board. Viewing along a downward-from-top direction, the second inner clamping portion 26*b* is covered by the second inner elastic arm 231*b*, and the second outer clamping portion 27*b* is exposed to an outer side of the second outer elastic arm 232*b*.

As shown in FIG. 4 to FIG. 6, the first differential signal terminal 2*a* and second differential signal terminal 2*b* in each differential signal terminal pair 2 are arranged symmetrically. The first inner elastic arm 231*a* and the second inner elastic arm 231*b* are adjacent and parallel to each other. A consistent pitch is formed between the first contact portions 24*a* and the adjacent second contact portions 24*b* in each row. A distance between the first inner clamping portion 26*a* and the second inner clamping portion 26*b* is equal to a distance between the first outer clamping portion 27*a* and the second outer clamping portion 27*b*. A first distance d1 is formed between the first inner elastic arm 231*a* and second inner elastic arm 231*b* in each differential signal terminal pair 2, and a second distance d2 is formed between a first outer elastic arm 232*a* and an adjacent second outer elastic arm 232*b* in two adjacent differential signal terminal pairs 2. The first distance d1 is less than the second distance d2, such that a distance between the first differential signal terminal 2*a* and the second differential signal terminal 2*b* is reduced, the coupling of the first differential signal terminal 2*a* and the second differential signal terminal 2*b* is enhanced, and high frequency crosstalk is effectively alleviated. A pitch between the first through slot 25*a* and the second through slot 25*b* is less than the pitch between the first contact portion 24*a* and the second contact portion 24*b*. That is, a distance d3 between a virtual center line L1 of the first through slot 25*a* and a virtual center line L2 of the second through slot 25*b* is less than a pitch d4 between a virtual center line M1 of the first contact portion 24*a* and a virtual center line M2 of the second contact portion 24*b*.

As shown in FIG. 4 to FIG. 6, a strip 4 is provided with a row of connecting portions 41 at intervals. Each connecting portion 41 extends downward to form a first branch 42 and a second branch 43 side-by-side, and a slit 44 is formed between the first branch 42 and the second branch 43. The second strip connecting portion 22*b* is connected to a tail end of the first branch 42, and the first strip connecting portion 22*a* is connected to a tail end of the second branch 43. A first differential signal terminal 2*a* and second differential signal terminal 2*b* between two adjacent connecting portions 41 form a differential signal terminal pair 2. A connecting portion 41 connects a first differential signal terminal 2*a* and a second differential signal terminal 2*b*, such that a distance between the first differential signal terminal 2*a* and second differential signal terminal 2*b* between two adjacent connecting portions 41 is reduced, thus saving materials.

To sum up, the electrical connector 100 according to certain embodiments of the present invention has the following beneficial effects:

(1) A connecting portion 41 connects a first differential signal terminal 2*a* and a second differential signal terminal 2*b*, such that a distance between the first differential signal terminal 2*a* and second differential signal terminal 2*b* between two adjacent connecting portions 41 is reduced, thus saving materials, increasing the material utilization rate, and saving space thereof.

(2) The first strip connecting portion 22*a* and the second strip connecting portion 22*b* are located at the outer sides of the differential signal terminal pair 2. Further, the first contact portion 24*a* is located at an outer side of the virtual center line L1 of the first through slot 25*a*, and the second contact portion 24*b* is located at an outer side of the virtual center line L2 of the second through slot 25*b*, thereby reducing the distance between the first inner elastic arm 231*a* and the second inner elastic arm 231*b* of the differential signal terminal pair 2, and the crosstalk is reduced. On the other hand, a first distance is formed between the first inner elastic arm 231*a* and second inner elastic arm 231*b* in each differential signal terminal pair 2, and a second distance is formed between a first outer elastic arm 232*a* and an adjacent second outer elastic arm 232*b* in two adjacent differential signal terminal pairs 2. The first distance is less than the second distance, such that a distance between the first differential signal terminal 2*a* and the second differential signal terminal 2*b* is reduced, and high frequency crosstalk is effectively alleviated.

(3) The first inner elastic arm 231*a* is parallel to the second inner elastic arm 231*b*. That is, viewing along a downward-from-top direction, an inner side edge of the first inner elastic arm 231*a* is on a straight line, and an inner side edge of the second inner elastic arm 231*b* is on a straight line, such that the first inner elastic arm 231*a* and second inner elastic arm 231*b* do not bend leftward or rightward and may be conveniently formed, allowing easier forming of the first differential signal terminal 2*a* and the second differential signal terminal 2*b*.

(4) The first elastic arm 23*a* is provided with the first through slot 25*a*, and the second elastic arm 23*b* is provided with the second through slot 25*b*, such that normal forces of the first differential signal terminal 2*a* and the second differential signal terminal 2*b* may be reduced.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body; and a plurality of differential signal terminal pairs accommodated in the insulating body, wherein each of the differential signal terminal pairs is formed by two differential signal terminals, and each of the differential signal terminals has:

a main body portion;

a strip connecting portion extending upward from an outer side of the main body portion;

an elastic arm extending upward from the main body portion; and a contact portion formed by extending upward from the elastic arm, wherein a through slot runs through the elastic arm, such that the elastic arm forms an inner elastic arm and an outer elastic arm at two opposite sides of the through slot, the outer elastic arm is adjacent to the strip connecting portion, the through slot does not extend to the contact portion, the contact portion is located at an outer side of a virtual center line of the through slot, and a consistent pitch is formed between the contact portions of the differential signal terminals.

2. The electrical connector according to claim 1, wherein in each of the differential signal terminal pairs, the two adjacent inner elastic arms of the two differential signal terminals are parallel, and a pitch between the two through slots of the two differential signal terminals is shorter than the pitch between the two contact portions of the two differential signal terminals.

3. The electrical connector according to claim 1, wherein an inner clamping portion and an outer clamping portion extend from the main body portion, the inner clamping portion and the outer clamping portion clamp a solder ball, and along a downward-from-top direction, the inner clamping portion is covered by the inner elastic arm, and the outer clamping portion is exposed at an outer side of the outer elastic arm.

4. The electrical connector according to claim 1, wherein a strip is provided with a row of connecting portions at intervals, each of the connecting portions connects the strip connecting portions of two of the differential signal terminals, and the two differential signal terminals between two adjacent ones of the connecting portions form one of the differential signal terminal pairs.

5. An electrical connector, comprising:

an insulating body; and a plurality of differential signal terminal pairs accommodated in the insulating body, wherein each of the differential signal terminal pairs is formed by two differential signal terminals, and each of the differential signal terminals has:

a main body portion;

a strip connecting portion extending upward from an outer side of the main body portion;

an elastic arm extending upward from the main body portion; and a contact portion formed by extending upward from the elastic arm, wherein a through slot runs through the elastic arm, such that the elastic arm forms an inner elastic arm and an outer elastic arm at two opposite sides of the through slot, the outer elastic arm is adjacent to the strip connecting portion, the through slot does not extend to the contact portion, a consistent pitch is formed between the contact portions of the differential signal terminals, a first distance is formed between the two adjacent inner elastic arms of the two differential signal terminals in each of the differential signal terminal pairs, a second distance is formed between two adjacent outer elastic arms of two adjacent differential signal terminals in two adjacent ones of the differential signal terminal pairs, and the first distance is less than the second distance.

6. The electrical connector according to claim 5, wherein in each of the differential signal terminal pairs, the two adjacent inner elastic arms of the two differential signal terminals are parallel, and a pitch between the two through slots of the two differential signal terminals is shorter than the pitch between the two contact portions of the two differential signal terminals.

7. The electrical connector according to claim 5, wherein the main body portion is flat plate shaped, the inner elastic arm and the outer elastic arm are located at one side of the main body portion, and a top surface of the contact portion upward abuts a chip module.

8. The electrical connector according to claim 5, wherein the contact portion is located at an outer side of a virtual center line of the through slot, and the two strip connecting portions of the two differential signal terminals in each respective differential signal terminal pair of the differential signal terminal pairs are respectively located at outer sides of the respective differential signal terminal pair.

9. The electrical connector according to claim 5, wherein a strip is provided with a row of connecting portions at intervals, each of the connecting portions connects the strip connecting portions of two of the differential signal terminals, and the two differential signal terminals between two adjacent ones of the connecting portions form one of the differential signal terminal pairs.

10. The electrical connector according to claim 5, wherein an inner clamping portion and an outer clamping portion extend from the main body portion, the inner clamping portion and the outer clamping portion clamp a solder ball, and along a downward-from-top direction, the inner clamping portion is covered by the inner elastic arm, and the outer clamping portion is exposed at an outer side of the outer elastic arm.

* * * * *